US010801783B2

(12) United States Patent
Jin et al.

(10) Patent No.: US 10,801,783 B2
(45) Date of Patent: Oct. 13, 2020

(54) HEAT EXCHANGER AND HEAT EXCHANGE MODULE

(71) Applicant: Danfoss Micro Channel Heat Exchanger (Jiaxing) Co., Ltd., Zhejiang (CN)

(72) Inventors: Junfeng Jin, Zhejiang (CN); Pierre Olivier Pelletier, Zhejiang (CN); Huan Jin, Zhejiang (CN)

(73) Assignee: DANFOSS MICRO CHANNEL HEAT EXCHANGER (JIAXING) CO., LTD., Zhejiang (CN)

( * ) Notice: Subject to any disclaimer, the term of this patent is extended or adjusted under 35 U.S.C. 154(b) by 104 days.

(21) Appl. No.: 16/301,795

(22) PCT Filed: Jan. 6, 2017

(86) PCT No.: PCT/CN2017/070408
§ 371 (c)(1),
(2) Date: Nov. 15, 2018

(87) PCT Pub. No.: WO2017/197908
PCT Pub. Date: Nov. 23, 2017

(65) Prior Publication Data

US 2019/0154342 A1 May 23, 2019

(30) Foreign Application Priority Data

May 16, 2016 (CN) ..... 2016 1 0323252

(51) Int. Cl.
*F28D 1/04* (2006.01)
*F28D 1/053* (2006.01)
(Continued)

(52) U.S. Cl.
CPC ..... *F28D 1/0443* (2013.01); *F25B 39/00* (2013.01); *F28D 1/04* (2013.01); *F28D 1/0417* (2013.01);
(Continued)

(58) Field of Classification Search
CPC ..... F25B 39/00; F28D 1/04; F28D 1/0443
(Continued)

(56) References Cited

U.S. PATENT DOCUMENTS 4,261,418 A * 4/1981 Helt ..... F24F 1/50 165/134.1
5,086,835 A 2/1992 Shinmura
(Continued)

FOREIGN PATENT DOCUMENTS

CN 103270386 A 8/2013
CN 103925742 A 7/2014
(Continued)

OTHER PUBLICATIONS

First Examination Report for Indian Serial No. 201817040754 dated Nov. 6, 2019.
(Continued)

*Primary Examiner* — Henry T Crenshaw
(74) *Attorney, Agent, or Firm* — McCormick, Paulding & Huber PLLC

(57) ABSTRACT

A heat exchanger (10) comprises: a first sub-heat exchanger (100), which has a first manifold (110), a second manifold (120), and at least two heat exchange tubes (130); and a second sub-heat exchanger (200), which has a third manifold (210), a fourth manifold (220), and at least one heat exchange tube (230), at least one of the heat exchange tubes (130) in the first sub-heat exchanger (100) being part of a flow path of the second sub-heat exchanger (200).

15 Claims, 9 Drawing Sheets

(51) Int. Cl.

| | |
|---|---|
| ***F28F 9/26*** | (2006.01) |
| ***F25B 39/00*** | (2006.01) |
| ***F28D 21/00*** | (2006.01) |
| ***F28F 9/02*** | (2006.01) |
| ***F24F 1/18*** | (2011.01) |
| ***F28D 1/02*** | (2006.01) |

(52) U.S. Cl.
CPC ..... *F28D 1/0426* (2013.01); *F28D 1/05325* (2013.01); *F28D 1/05366* (2013.01); *F28D 1/05375* (2013.01); *F28F 9/262* (2013.01); *F24F 1/18* (2013.01); *F28D 2001/0266* (2013.01); *F28D 2001/0273* (2013.01); *F28D 2021/0068* (2013.01); *F28F 9/0204* (2013.01); *F28F 9/0243* (2013.01)

(58) Field of Classification Search
USPC ..... 165/144
See application file for complete search history.

(56) References Cited

U.S. PATENT DOCUMENTS

| | | | | |
|---|---|---|---|---|
| 2006/0086488 | A1* | 4/2006 | Heng-I | F28F 1/32 165/151 |
| 2007/0051502 | A1 | 3/2007 | Yamauchi | |
| 2007/0204978 | A1* | 9/2007 | Beamer | F28D 1/05366 165/124 |
| 2009/0084131 | A1* | 4/2009 | Reifel | F24F 13/30 62/515 |
| 2010/0162739 | A1* | 7/2010 | Kopko | F25D 23/00 62/115 |
| 2011/0094257 | A1* | 4/2011 | Rusignuolo | F28D 1/0443 62/498 |
| 2012/0125033 | A1* | 5/2012 | Tanno | F28D 1/0477 62/324.1 |
| 2012/0227731 | A1* | 9/2012 | Tamaura | F24S 23/79 126/664 |
| 2013/0240186 | A1* | 9/2013 | Taras | F28D 1/05358 165/146 |

FOREIGN PATENT DOCUMENTS

| | | | |
|---|---|---|---|
| CN | 204329670 | U | 5/2015 |
| CN | 205784008 | U | 12/2016 |
| WO | 2011013672 | A1 | 1/2013 |

OTHER PUBLICATIONS

International Search Report for Serial No. PCT/CN2017/070408 Dated Apr. 11, 2017.

* cited by examiner

HEAT EXCHANGER AND HEAT EXCHANGE MODULE

CROSS-REFERENCE TO RELATED APPLICATIONS

This application is a National Stage application of International Patent Application No. PCT/CN2017/070408, filed on Jan. 6, 2017, which claims priority to Chinese Patent Application No. 201610323252.7, filed on May 16, 2016 each of which is hereby incorporated by reference in its entirety.

TECHNICAL FIELD

The present invention relates to the field of air conditioning, and more specifically, to a heat exchanger and a heat exchange module in the technical field of commercial air conditioning.

BACKGROUND

The prior art document WO2011013672 discloses a heat source unit. Specifically, the heat source unit is provided with air heat exchangers, wherein each of the air heat exchangers comprises a plurality of heat dissipation sheets disposed at specified intervals, heat exchange tubes passing through the heat dissipation sheets, bent sheet portions which extend on two sides and are bent in the same direction, and heat exchange modules. Each of the heat exchange modules comprises two air heat exchangers, wherein each of the air heat exchangers has a bent portion disposed in a manner opposite that of a bent portion of another air heat exchanger. The air heat exchangers are inclined, so that lower edges are close to each other and upper edges are spaced apart. Thus, the heat exchange module is substantially V-shaped in a side view.

However, edges of the heat exchangers on the left and right sides in the foregoing heat source unit are spaced apart in the upper portion of the V-shaped construction. Thus, a shielding plate (or a metal plate) is still needed to connect the two heat exchangers, and as a result, the space between the two heat exchangers is not effectively utilized.

In view of this, there is still a need for a new heat exchanger and heat exchange module which are capable of at least partially solving the above problem.

SUMMARY

The present invention provides a heat exchanger, comprising:

a first sub-heat exchanger having a first manifold, a second manifold, and at least two heat exchange tubes which extend between the first manifold and the second manifold and are in fluid communication with the first manifold and the second manifold; and a second sub-heat exchanger having a third manifold, a fourth manifold, and at least one heat exchange tube which extends between the third manifold and the fourth manifold and is in fluid communication with the third manifold and the fourth manifold, wherein at least one of the heat exchange tubes in the first sub-heat exchanger is part of a flow path of the second sub-heat exchanger.

According to one embodiment of the present invention, the first sub-heat exchanger comprises a first heat exchange region and a second heat exchange region, wherein the first heat exchange region and the second heat exchange region are spaced apart by a first partition disposed in the first manifold and are distributed in a longitudinal direction of the manifold; the first sub-heat exchanger comprises a first inlet, a second inlet, and a first outlet, and the second sub-heat exchanger comprises a third inlet and a second outlet, wherein the first inlet is located in the first heat exchange region, and the second inlet and the first outlet are located in the second heat exchange region; and the second outlet is in fluid communication with the second inlet.

According to one embodiment of the present invention, the first heat exchange region and the second heat exchange region are in fluid communication by means of the second manifold.

According to one embodiment of the present invention, a second partition is disposed in the second manifold, so that the first heat exchange region and the second heat exchange region are not in fluid communication, and a third outlet is provided in the first heat exchange region, so that a refrigerant entering the first inlet passes through the first heat exchange region and then exits from the third outlet.

According to one embodiment of the present invention, the first sub-heat exchanger further comprises a third heat exchange region, wherein the third heat exchange region is spaced apart from the first heat exchange region and the second heat exchange region by a third partition in the first manifold and a fourth partition in the second manifold, a fourth inlet and a fourth outlet are provided in the third heat exchange region, and the fourth outlet is in fluid communication with the third inlet.

According to one embodiment of the present invention, the second manifold and the third manifold are fixed adjacent to each other, the fourth outlet and the second inlet are provided on the second manifold, and the third inlet and the second outlet are provided on the third manifold.

According to one embodiment of the present invention, the fourth outlet and the third inlet are respectively provided at end portions, on the same side, of the second manifold and the third manifold, and the fourth outlet is in fluid communication with the third inlet by means of a U-shaped tube; and the second inlet and the second outlet are respectively provided at end portions, on the other side, of the second manifold and the third manifold, and the second inlet is in fluid communication with the second outlet by means of another U-shaped tube.

According to one embodiment of the present invention, the second manifold and the third manifold are fixed adjacent to each other, the first inlet is provided on the first manifold, the third inlet is provided on the third manifold, the third inlet is connected to an external pipeline extending in the direction of the heat exchange tubes of the first sub-heat exchanger, and an inlet end portion of the external pipeline and the first inlet are provided on the same side of the heat exchanger.

According to one embodiment of the present invention, the first manifold and the third manifold are fixed adjacent to each other, the first inlet and the first outlet are provided on the first manifold, the second inlet is provided on the second manifold, the second outlet and the third inlet are provided on the third manifold, and the second inlet is in fluid communication with the second outlet by means of an external pipeline extending in the direction of the heat exchange tubes of the first sub-heat exchanger.

According to one embodiment of the present invention, the heat exchanger is a heat exchanger for a heat exchange apparatus on an air-cooled water chilling unit or a commercial rooftop unit, wherein one of the first sub-heat exchanger and the second sub-heat exchanger is a main heat exchanger which is disposed in a longitudinal direction of the heat exchange apparatus and which is substantially quadrilateral, and the other of the first sub-heat exchanger and the second sub-heat exchanger is a lateral heat exchanger which forms a predetermined included angle greater than zero with the first sub-heat exchanger and which is substantially trapezoidal.

According to one embodiment of the present invention, the lateral heat exchanger is composed of flat tubes and fins having gradually decreasing lengths, wherein assuming that the length of a first flat tube is $L_{flat1}$ and the length of a fin is $L_{fin1}$, then the dimensions of the lateral heat exchanger satisfy the following conditions:

the length of an $n^{th}$ flat tube is $L_{flatn}=L_{flat1}-2(n-1)*H*\tan(\alpha/2)$, the length of an $n^{th}$ fin is $L_{finn}=L_{fin1}-2(n-1)*H*\tan(\alpha/2)$, $H1=H*\cos(\alpha/2)$, and $\alpha1=180-(\alpha/2)$, where H is a centre-to-centre spacing of the flat tubes, a is an included angle between the third manifold and the fourth manifold, H1 is a groove-to-groove spacing on the manifolds, and $\alpha1$ is a bending angle of the flat tubes.

According to one embodiment of the present invention, at least two heat exchange tubes are disposed in the second heat exchange region, a fifth partition is disposed on a section, corresponding to the second heat exchange region, of the second manifold to divide the heat exchange tubes in the second heat exchange region into two groups, so that a refrigerant passing through the first heat exchange region passes through one group of heat exchange tubes in the second heat exchange region, and a refrigerant entering the second inlet passes through the other group of heat exchange tubes in the second heat exchange region, and the refrigerants passing through the two groups of heat exchange tubes in the second heat exchange region are mixed in the first manifold and then exit from the first outlet.

According to one embodiment of the present invention, the first sub-heat exchanger comprises a first heat exchange region and a third heat exchange region, wherein the third heat exchange region is spaced apart from the first heat exchange region by a third partition in the first manifold and a fourth partition in the second manifold, the first sub-heat exchanger comprises a first inlet and a third outlet that are located in the first heat exchange region and a fourth inlet and a fourth outlet that are located in the third heat exchange region, and the second sub-heat exchanger comprises a third inlet and a second outlet, wherein the fourth outlet is in fluid communication with the third inlet.

The present invention further provides a heat exchange module for a heat exchange apparatus on an air-cooled water chilling unit or a commercial rooftop unit, the heat exchange module comprising at least one heat exchanger described above.

In the heat exchanger and the heat exchange module according to the present invention, the lateral space of the heat exchange module in the heat exchange apparatus on the air-cooled water chilling unit or the commercial rooftop unit is sufficiently utilized, the space utilization rate is high and bending or more complex processes are not necessary. The heat exchanger and the heat exchange module according to the present invention have a large heat exchange area, and the heat exchange area is increased by 20% or more compared with that of a conventional rectangular heat exchanger. With regard to the heat exchanger and the heat exchange module according to the present invention, by means of pipeline connections of the heat exchanger, a more flexible selection regarding transporting an assembly or two separate sheets can be made, such that it becomes convenient and simple to manufacture, transport, and assemble the heat exchange module, and the costs are reduced.

BRIEF DESCRIPTION OF THE DRAWINGS

These and/or other aspects and advantages of the present invention will become apparent and should be readily understood from the following description of the preferred embodiments in conjunction with the accompanying drawings, in which.

DETAILED DESCRIPTION

The technical solutions of the present invention are further specifically described below by means of the embodiments and in conjunction with FIGS. 1-15. In the description, identical or similar reference signs denote identical or similar components. The following description of the embodiments of the present invention, which refers to the accompanying drawings, is intended to explain the general inventive concept of the present invention, and should not be construed as limiting the present invention.

It should be understood that the terms such as first, second, third, and fourth used in the descriptions do not mean that the relevant elements are sequentially arranged, but are instead used to distinguish among the relevant elements, and therefore do not constitute a limitation on the present invention. The exemplary descriptions of a lateral heat exchanger and a main heat exchanger or a rectangular heat exchanger and a trapezoidal heat exchanger do not constitute a limitation on the present invention, and the descriptions thereof can be interchanged without causing any conflict.

Figure 1:
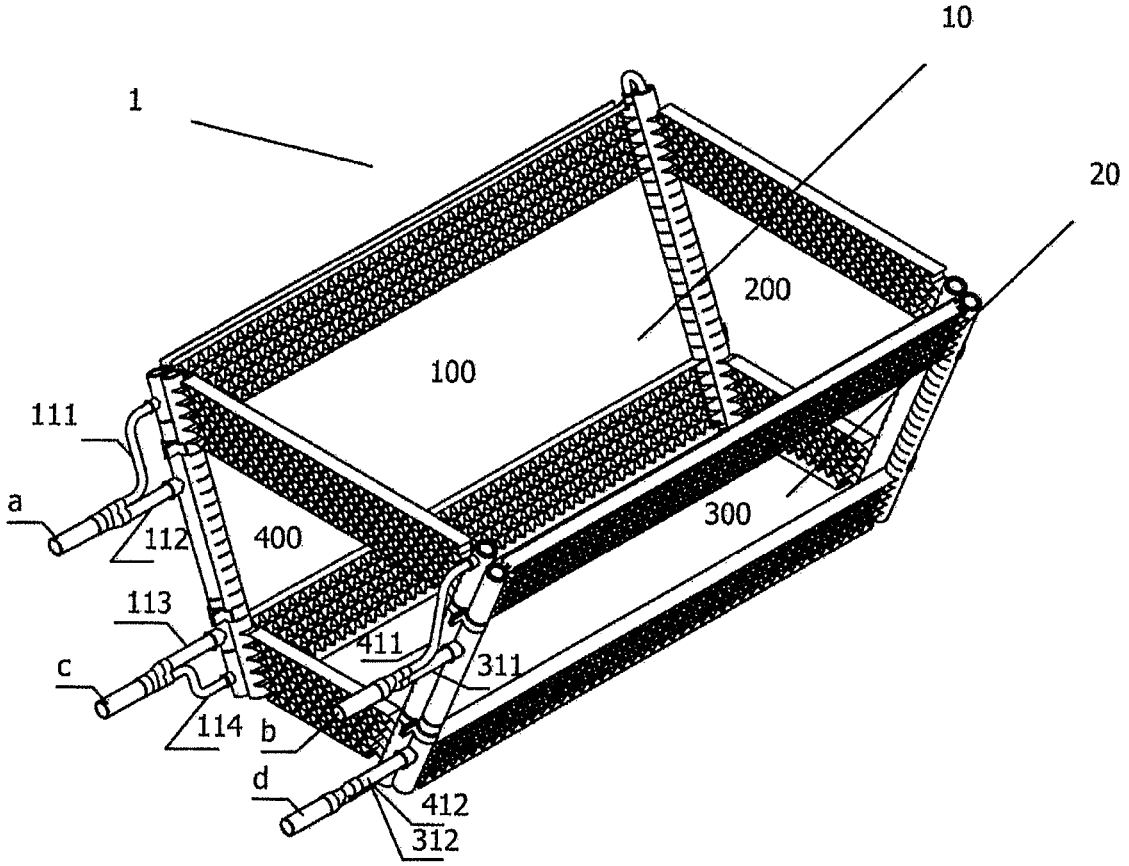
FIG. 1 is a perspective view of a heat exchange module according to an embodiment of the present invention.

FIG. 1 is a perspective view of a heat exchange module 1 for a heat exchange apparatus on an air-cooled water chilling unit or a commercial rooftop unit according to a first embodiment of the present invention. The heat exchange module 1 is of a substantially enclosed structure in which same is surrounded by heat exchangers, and has two substantially quadrilateral lateral portions which are opposite each other and two substantially trapezoidal lateral portions which are opposite each other. The heat exchange module 1 comprises a first heat exchanger 10 and a second heat exchanger 20, wherein the first heat exchanger 10 has an inlet a and an outlet c, and the second heat exchanger 20 has an inlet b and an outlet d.

The first heat exchanger 10 according to an embodiment of the present invention is described below in detail in conjunction with FIGS. 2-6.

Figure 2:
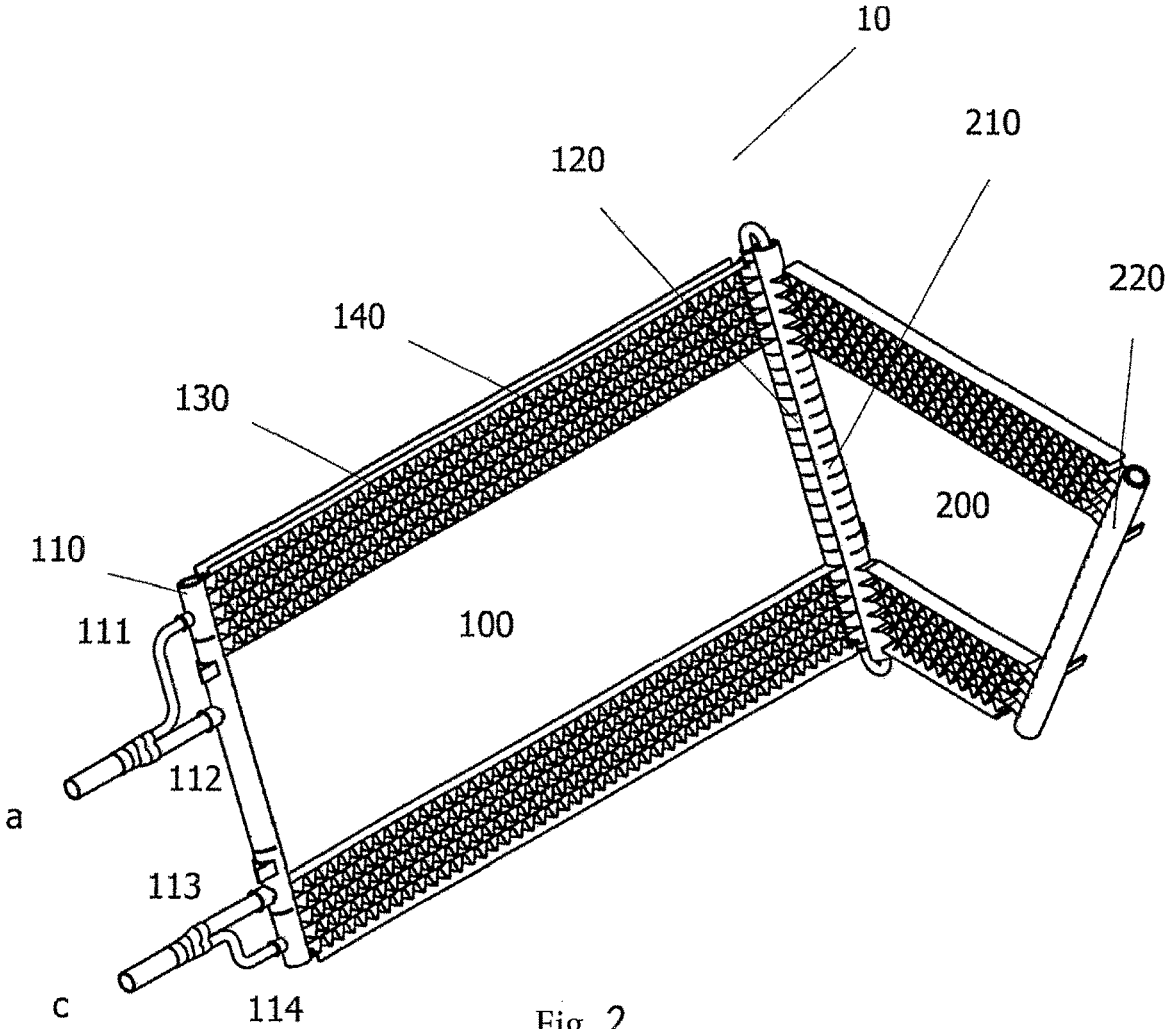
FIG. 2 is a perspective view of a first heat exchanger according to one embodiment of the present invention in the heat exchange module shown in FIG. 1.
Figure 3:
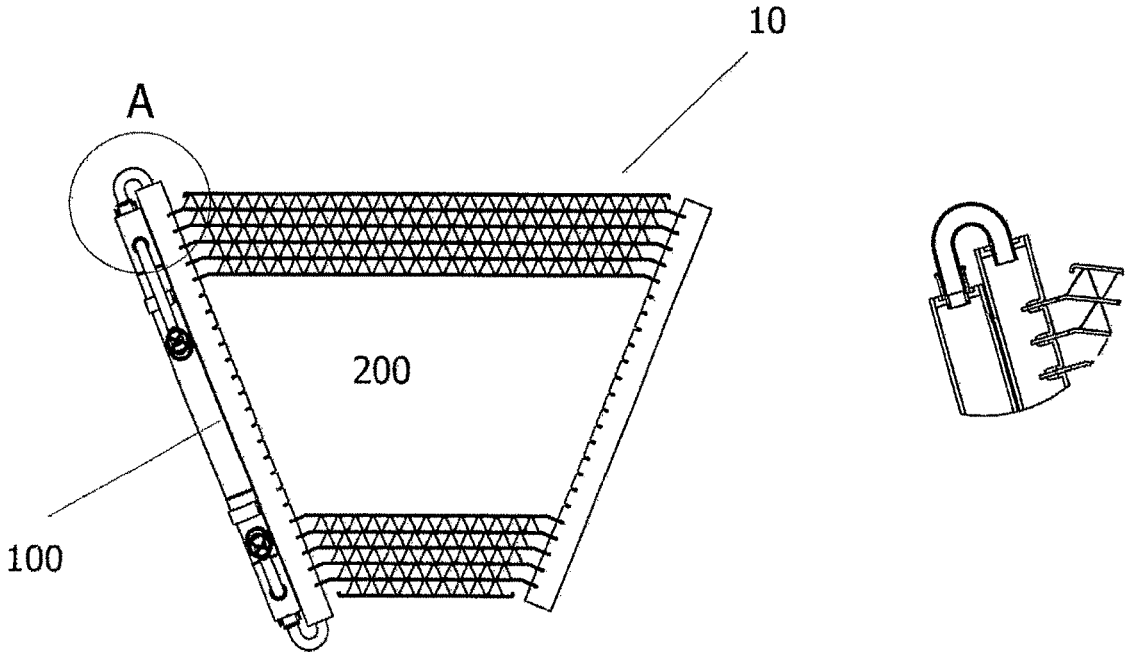
FIG. 3 is a side view of the first heat exchanger shown in FIG. 2 and a partial enlarged view of a connecting part between a first sub-heat exchanger and a second sub-heat exchanger in the first heat exchanger.

FIG. 2 is a perspective view of the first heat exchanger 10 according to one embodiment of the present invention in the heat exchange module 1 shown in FIG. 1. FIG. 3 is a side view of the first heat exchanger 10 shown in FIG. 2 and a partial enlarged view of a connecting part between a first sub-heat exchanger 100 and a second sub-heat exchanger 200 in the first heat exchanger 10. As shown in FIG. 2, the first heat exchanger 10 comprises the first sub-heat exchanger 100 and the second sub-heat exchanger 200. The first sub-heat exchanger 100 and the second sub-heat exchanger 200 respectively constitute a substantially quadrilateral main heat exchanger and a substantially trapezoidal lateral heat exchanger, which are adjacent to each other, in the heat exchange module 1. It can be understood that the first sub-heat exchanger 100 and the second sub-heat exchanger 200 can also respectively constitute a substantially trapezoidal lateral heat exchanger and a substantially quadrilateral main heat exchanger, which are adjacent to each other, in the heat exchange module 1. The first sub-heat exchanger 100 is disposed in a longitudinal direction of the heat exchange apparatus. The second sub-heat exchanger 200 and the first sub-heat exchanger 100 form a predetermined included angle greater than zero, and preferably, the two sub-heat exchangers are disposed such that same are substantially perpendicular to each other.

Figure 4:
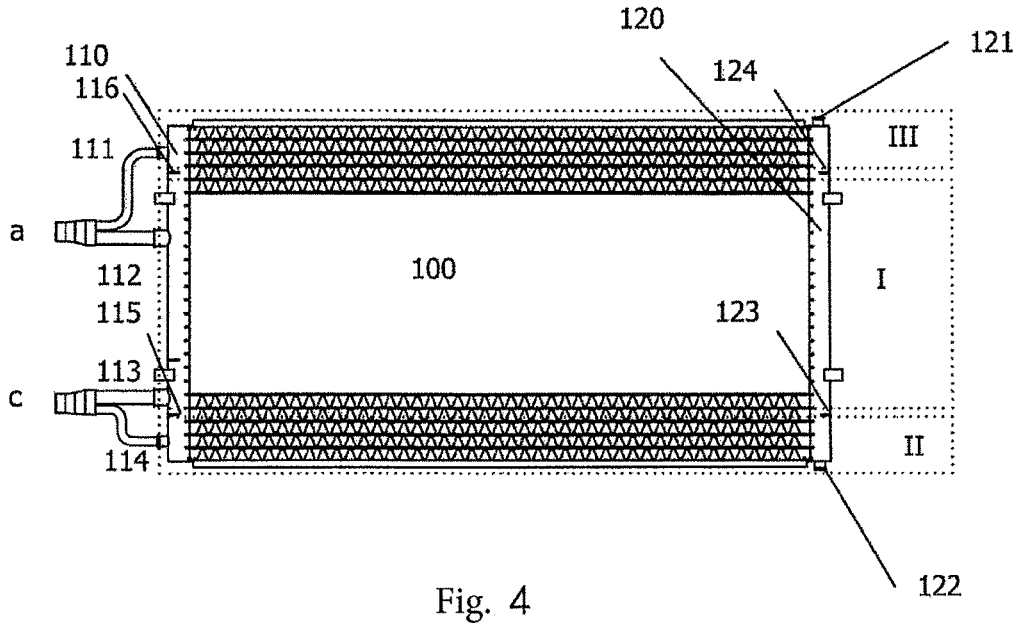
FIG. 4 is a front view of the first sub-heat exchanger of the first heat exchanger shown in FIG. 2.
Figure 5:
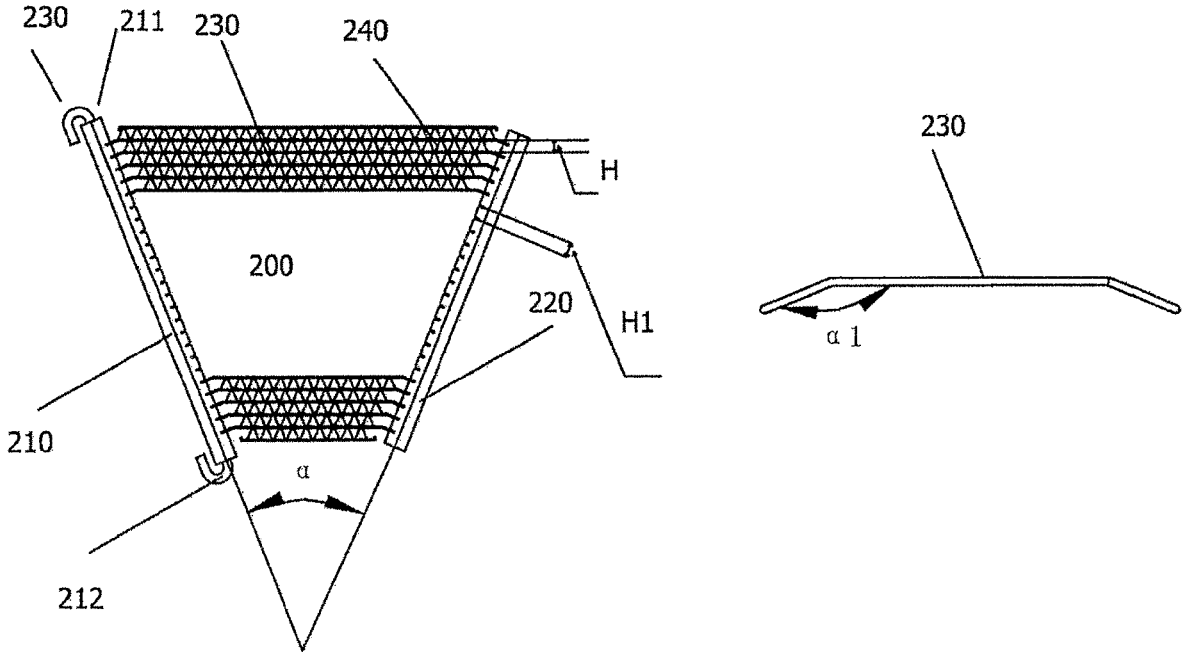
FIG. 5 is a front view of the second sub-heat exchanger of the first heat exchanger shown in FIG. 2 and a front view of heat exchange tubes of the second sub-heat exchanger.

FIG. 4 is a front view of the first sub-heat exchanger 100 of the first heat exchanger 10 shown in FIG. 2. FIG. 5 is a front view of the second sub-heat exchanger 200 of the first heat exchanger 10 shown in FIG. 2 and a front view of heat exchange tubes 230 of the second sub-heat exchanger. The first sub-heat exchanger 100 has a first manifold 110, a second manifold 120, and at least two heat exchange tubes 130 which extend between the first manifold 110 and the second manifold 120 and are in fluid communication with the first manifold 110 and the second manifold 120. Fins 140 are disposed on the heat exchange tubes 130. The second sub-heat exchanger 200 has a third manifold 210, a fourth manifold 220, and at least one heat exchange tube 230 which extends between the third manifold 210 and the fourth manifold 220 and is in fluid communication with the third manifold 210 and the fourth manifold 220. Fins 240 are disposed on the heat exchange tube(s) 230.

Figure 6:
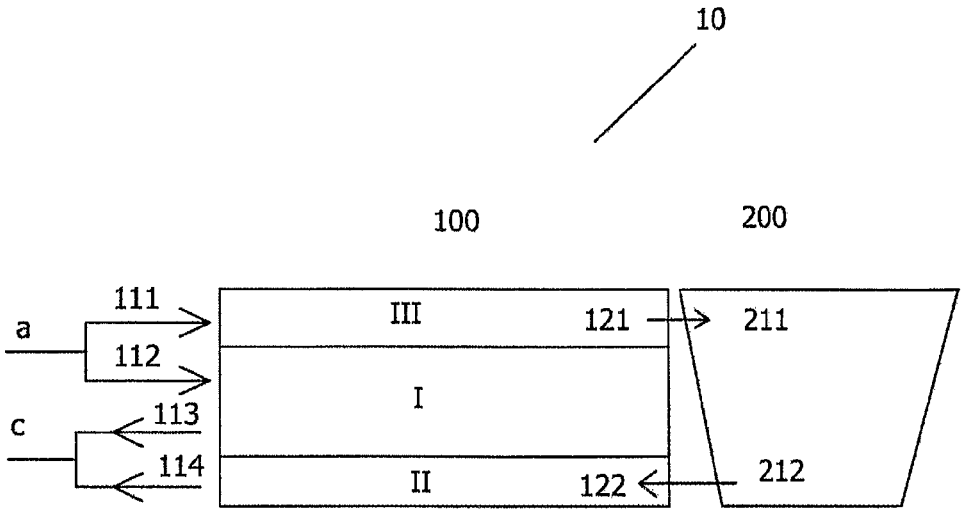
FIG. 6 is a schematic view of a flow path of the first heat exchanger shown in FIG. 2.

The first sub-heat exchanger 100 comprises a first heat exchange region I and a second heat exchange region II that are spaced apart by a first partition 115 in the first manifold 110. The first heat exchange region I and the second heat exchange region II are distributed in a longitudinal direction of the first manifold 110 and a longitudinal direction of the second manifold 120. As shown in FIGS. 4 and 6, the first sub-heat exchanger comprises a first inlet 112, a second inlet 122, and a first outlet 114. The second sub-heat exchanger comprises a third inlet 211 and a second outlet 212. The first inlet 112 is provided on a section, corresponding to the first heat exchange region I, of the first manifold 110; the first outlet 114 is provided on a section, corresponding to the second heat exchange region II, of the first manifold 110; and the second inlet 122 is provided on the second manifold 120. The second outlet 212 is in fluid communication with the second inlet 122.

In an embodiment of the present invention, a second partition 123 is disposed in the second manifold 120, so that the first heat exchange region I and the second heat exchange region II are not in fluid communication. At this time, a third outlet 113 is provided in the first heat exchange region I. A refrigerant entering the first heat exchange region I from the first inlet 112 undergoes heat exchange in the first heat exchange region I and then exits from the third outlet 113. A refrigerant entering the second manifold 120 from the second inlet 122 passes through the second heat exchange region II and then exits from the first outlet 114. That is, the refrigerants passing through the first heat exchange region I and the second heat exchange region II are not in fluid communication in the first sub-heat exchanger. The first inlet 112 and the third outlet 113 separately form a loop in the first heat exchange region I.

A person skilled in the art would understand that the second partition 123 may be omitted from the second manifold 120. Correspondingly, the third outlet 113 is omitted from the first heat exchange region I. At this time, the first heat exchange region I and the second heat exchange region II are in fluid communication by means of the second manifold 120. A refrigerant entering the first heat exchange region I from the first inlet 112 enters the second manifold 120 and is mixed with a refrigerant entering the second manifold 120 from the second inlet 122, and the mixture then passes through the second heat exchange region II. The refrigerants passing through the second heat exchange region II then exit from the first outlet 114, as described below in detail in conjunction with FIGS. 9 and 10.

A person skilled in the art would understand that as an alternative for the second partition 123, a fifth partition may be disposed on a section, corresponding to the second heat exchange region II, of the second manifold 120 to divide the heat exchange tubes in the second heat exchange region II into two groups, so that a refrigerant passing through the first heat exchange region I passes through one group of heat exchange tubes in the second heat exchange region II, and a refrigerant entering the second inlet 122 passes through the other group of heat exchange tubes in the second heat exchange region II. The refrigerants passing through the two groups of heat exchange tubes in the second heat exchange region II are mixed in the first manifold 110 and then exit from the first outlet 114, as described below in detail in conjunction with FIG. 15.

In an embodiment of the present invention, the first sub-heat exchanger further comprises a third heat exchange region III. The third heat exchange region III is spaced apart from the first heat exchange region I and the second heat exchange region II by a third partition 116 in the first manifold 110 and a fourth partition 124 in the second manifold 120. A fourth inlet 111 and a fourth outlet 121 are provided in the third heat exchange region III. The fourth outlet 121 is in fluid communication with the third inlet 211. The second manifold 120 and the third manifold 210 are fixed adjacent to each other in a connection manner known in the art, such as clamps and welding. The fourth outlet 121 and the second inlet 122 are provided on the second manifold 120, and the third inlet 211 and the second outlet 212 are provided on the third manifold 210. Specifically, the fourth outlet 121 is provided on a section, corresponding to the third heat exchange region III, of the second manifold 120, and the second inlet 122 is provided on a section, corresponding to the second heat exchange region II, of the second manifold 120. More specifically, the fourth outlet 121 and the third inlet 211 are respectively provided at end portions, on the same side, of the second manifold 120 and the third manifold 210, and the fourth outlet 121 is in fluid communication with the third inlet 211 by means of a U-shaped tube, as shown in FIG. 3. Similarly, the second inlet 122 and the second outlet 212 are respectively provided at end portions, on the other side, of the second manifold 120 and the third manifold 210, and the second inlet 122 is in fluid communication with the second outlet 212 by means of another U-shaped tube.

A person skilled in the art would understand that the third inlet 211 can also be connected to an external pipeline extending in the direction of the heat exchange tubes of the first sub-heat exchanger. An inlet end portion of the external pipeline and the first inlet 112 are provided on the same side of the heat exchanger 10, as described below in detail in conjunction with FIGS. 9 and 10.

A person skilled in the art would understand that, as needed, a further outlet may be provided on the second manifold 120 for communication with a further sub-heat exchanger to implement a further heat exchange function. The inlet a of the first heat exchanger 10 is divided into two pipelines for connection to the fourth inlet 111 and the first inlet 112 respectively. The third outlet 113 and the first outlet 114 on the first manifold 110 are converged into one pipeline to serve as the outlet c of the first heat exchanger 10.

It should be noted here that, for clarity, the sub-heat exchangers in the accompanying drawings comprise a main heat exchanger and a lateral heat exchanger. None of the heat exchange tubes and the fins in the middle is shown, instead, only heat exchange tubes and fins at the bordering portions are shown.

It can be understood that an outlet of the second sub-heat exchanger 200 may be disposed on the fourth manifold 220. At this time, an outlet on the fourth manifold 220 and the second inlet 122 on the second manifold are in fluid communication by means of a pipeline located outside the two sub-heat exchangers.

FIG. 6 is a schematic view of a flow path of the first heat exchanger 10 shown in FIG. 2. During use, as shown in FIG. 6, the fourth inlet 111, the heat exchange tubes in the third heat exchange region III, the fourth outlet 121, the third inlet 211, the second sub-heat exchanger 200, the second outlet 212, the second inlet 122, the second heat exchange region II, and the first outlet 114 form a first loop. The first inlet 112, one group of heat exchange tubes in the first heat exchange region I, the second manifold 120, the other group of heat exchange tubes in the first heat exchange region I, and the third outlet 113 form a separate second loop in the second heat exchange region II.

It can be understood that in the manifolds of the heat exchangers in the present invention, the description of a partition that obviously needs to be disposed by a person skilled in the art according to a loop requirement is omitted. Moreover, a person skilled in the art would understand that for a heat exchange portion in each loop, a plurality of partitions may be disposed in the manifolds so as to form a serpentine loop, thereby improving the heat exchange efficiency.

Preferably, the heat exchange tubes in the first heat exchanger 10 are all flat tubes. Fins in the second heat exchange region II may be different from the fins in the first heat exchange region I and the third heat exchange region III in terms of shape and arrangement structure.

A person skilled in the art would understand that as a variant, the first sub-heat exchanger 100 may also comprise only the first heat exchange region I and the third heat exchange region III, and not the second heat exchange region II. At this time, the first sub-heat exchanger 100 independently forms a loop in the first heat exchange region I. A refrigerant entering the third heat exchange region III flows into the second sub-heat exchanger 200, but no longer flows back through the first sub-heat exchanger 100. Instead, the second outlet 212 of the second sub-heat exchanger 200 may be, for example, in communication with the outlet c by means of a further pipeline. The second outlet 212 may also be provided on the fourth manifold 220.

The arrangement of the heat exchange tubes 230 and the fins 240 in the second sub-heat exchanger 200 is described below in detail in conjunction with FIG. 5.

The second sub-heat exchanger 200 is, as a whole, trapezoidal, and is used as a lateral heat exchanger that is constituted by flat tubes 230 and fins 240 having gradually decreasing lengths. At least one end portion of each flat tube may be bent to facilitate insertion into a manifold. Preferably, a bent section of the flat tube is vertically inserted into the manifold. Assuming that the length of a first flat tube at the upper portion is $L_{flat1}$ and the length of a fin on the first flat tube is $L_{fin1}$, then the dimensions of the lateral heat exchanger satisfy the following conditions:

from top to bottom, the length of an $n^{th}$ flat tube is $L_{flatn}=L_{flat1}-2(n-1)*H*\tan(\alpha/2)$, from top to bottom, the transverse distribution length of a fin on the $n^{th}$ flat tube is $L_{finn}=L_{fin1}-2(n-1)*H*\tan(\alpha/2)$, $H1=H*\cos(\alpha/2)$, and $\alpha1=180-(\alpha/2)$, where H is a centre-to-centre spacing of the flat tubes, $\alpha$ is an included angle formed between the third manifold 210 and the fourth manifold 220, H1 is a groove-to-groove spacing on the manifolds, that is, a spacing between the centres of openings for joining end portions of inserted flat tubes, $\alpha1$ is a bending angle of the flat tubes, that is, an angle formed between the bent section of a flat tube and a main body of the flat tube, as shown in FIG. 5, and n is a natural number.

Figure 7:
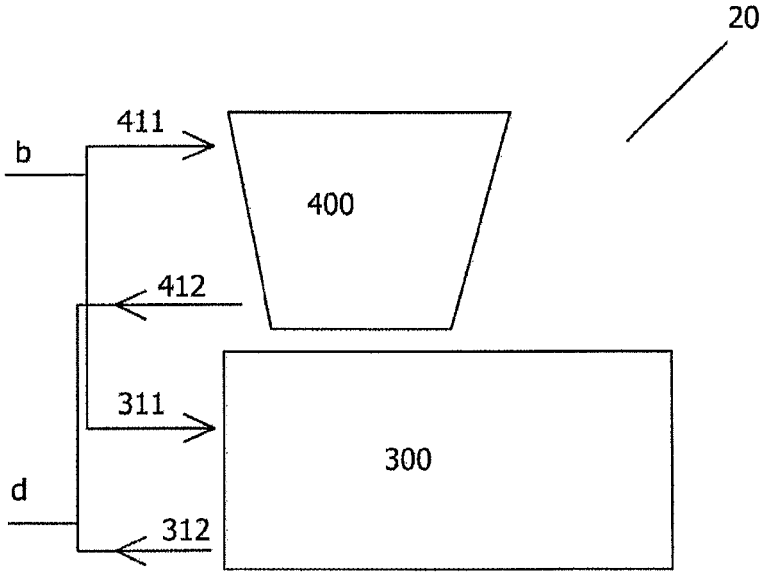
FIG. 7 is a schematic view of a flow path of a second heat exchanger in the heat exchange module shown in FIG. 1.

As shown in FIG. 1, the second heat exchanger 20 comprises a third sub-heat exchanger 300 and a fourth sub-heat exchanger 400. The third sub-heat exchanger 300 is of a quadrilateral shape that is substantially the same as that of the first sub-heat exchanger 100 so as to form another main heat exchanger of the heat exchange module 1. The fourth sub-heat exchanger 400 has a substantially trapezoidal shape substantially the same as that of the second sub-heat exchanger 200 so as to form another lateral heat exchanger of the heat exchange module 1. It can be understood that the third sub-heat exchanger 300 may be substantially trapezoidal, and the fourth sub-heat exchanger 400 may be substantially quadrilateral. FIG. 7 is a schematic view of a flow path of the second heat exchanger 20 in the heat exchange module 1 shown in FIG. 1. An inlet 311 of the third sub-heat exchanger 300 and an inlet 411 of the fourth sub-heat exchanger 400 are combined by means of a pipeline to form the inlet b located at the same corner portion of the second heat exchanger 20. An outlet 312 of the third sub-heat exchanger 300 and an outlet 412 of the fourth sub-heat exchanger 400 are combined by means of a pipeline to form the outlet d located at the same corner portion of the second heat exchanger 20. The third sub-heat exchanger 300 and the fourth sub-heat exchanger 400 per se are independent heat exchangers. The dimensions of the third sub-heat exchanger 300 and the fourth sub-heat exchanger 400 are substantially consistent with those of the first sub-heat exchanger 100 and the second sub-heat exchanger 200 respectively, and the details are not described herein.

Figure 8:
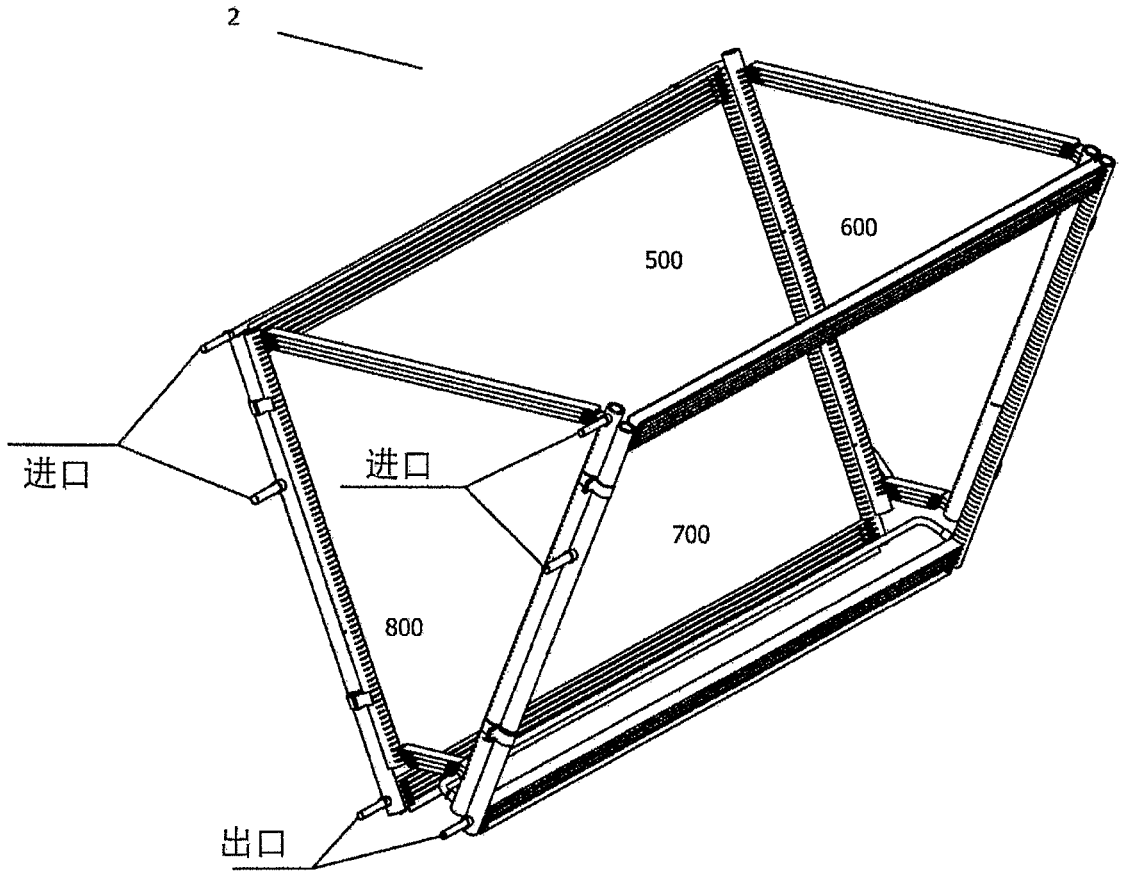
FIG. 8 is a perspective view of a heat exchange module according to another embodiment of the present invention.
Figure 9:
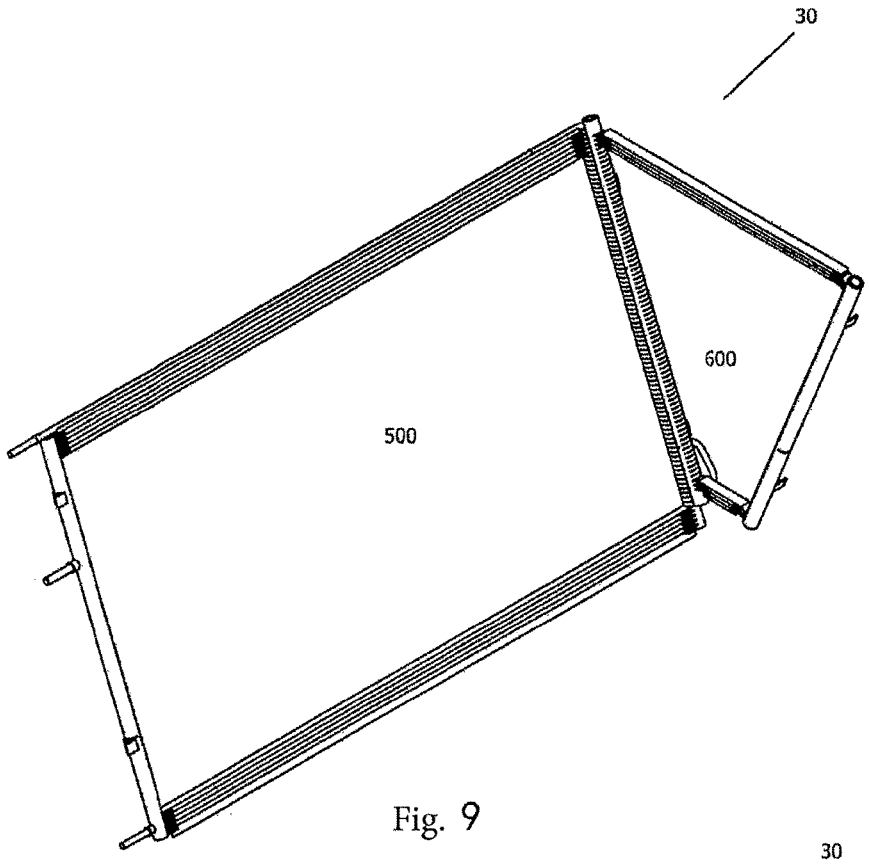
FIG. 9 is a perspective view of a first heat exchanger according to one embodiment of the present invention in the heat exchange module shown in FIG. 8.
Figure 10:
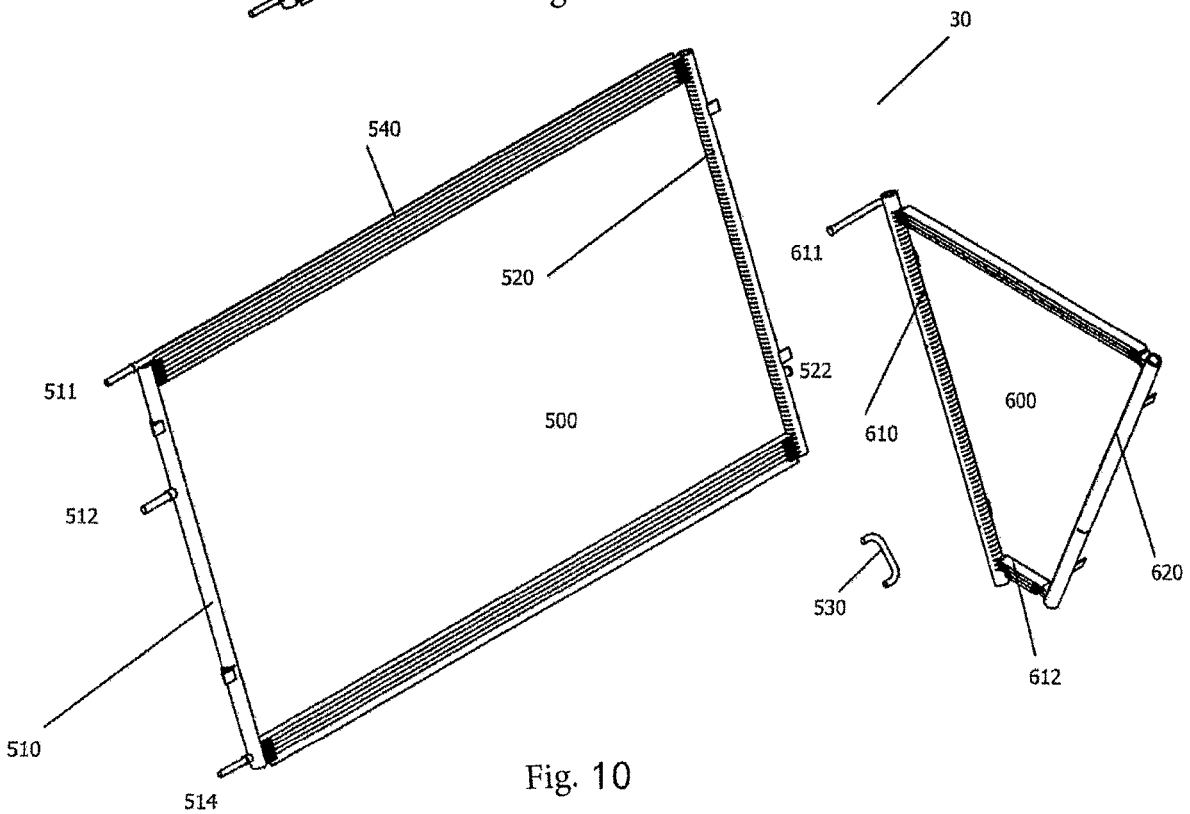
FIG. 10 is an exploded view of the first heat exchanger shown in FIG. 9.
Figure 11:
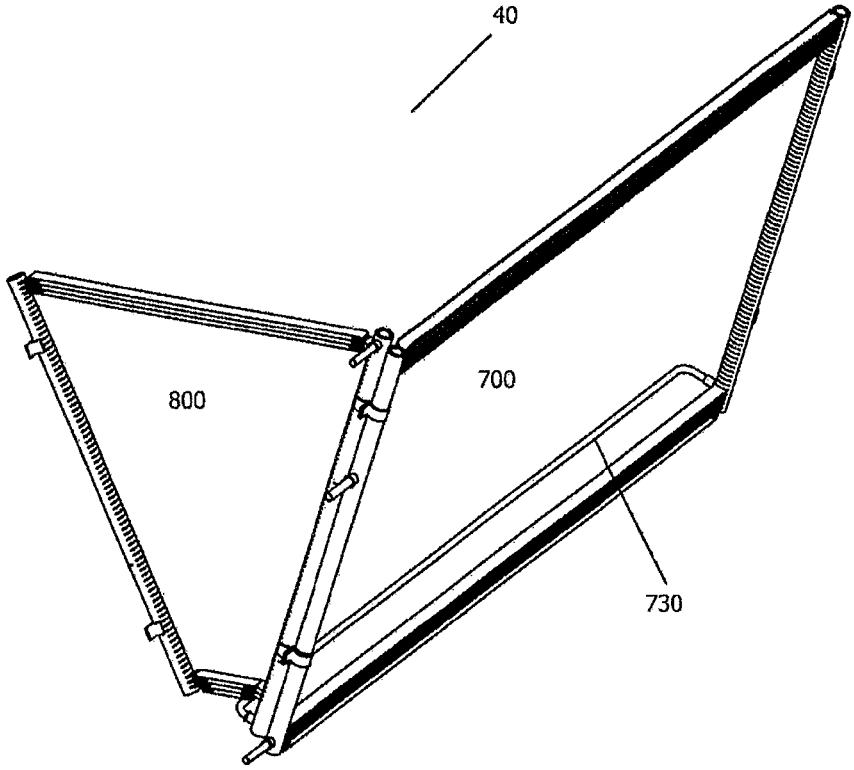
FIG. 11 is a perspective view of a second heat exchanger according to another embodiment of the present invention in the heat exchange module shown in FIG. 8.
Figure 12:
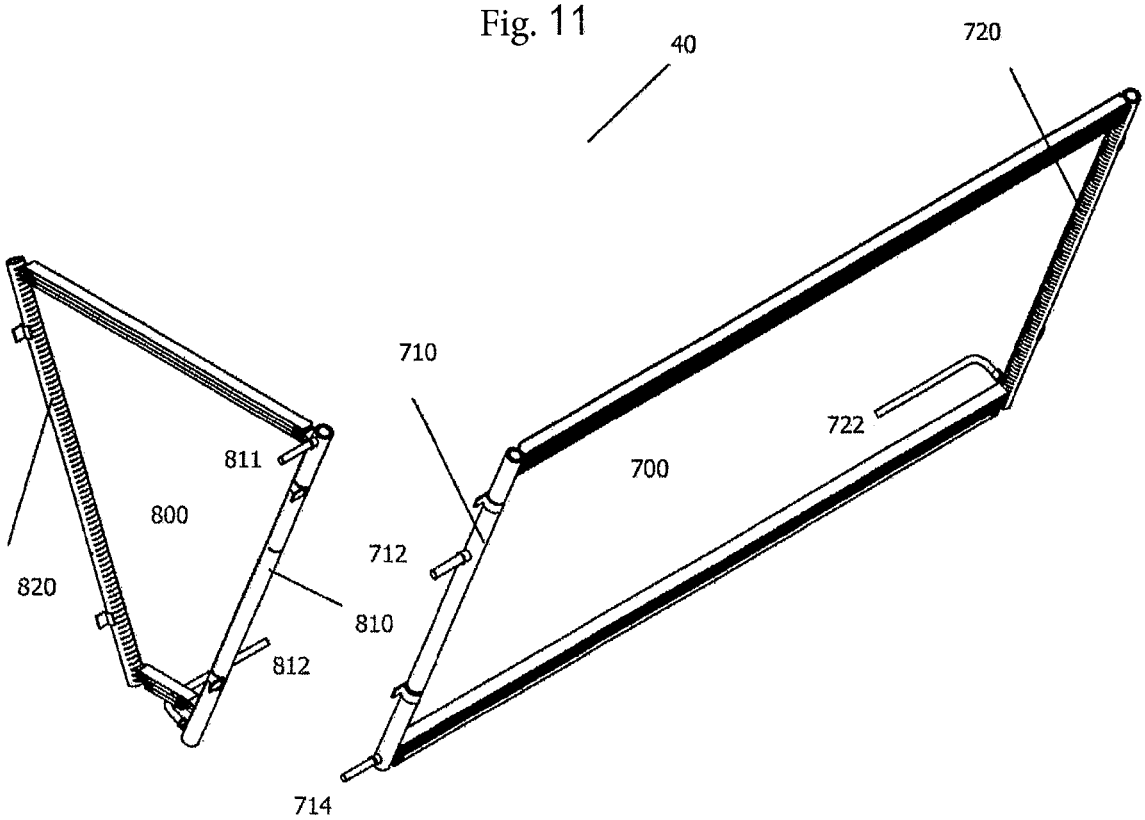
FIG. 12 is an exploded view of the second heat exchanger shown in FIG. 11.

FIG. 8 is a perspective view of a heat exchange module 2 according to a second embodiment of the present invention. FIG. 9 is a perspective view of a first heat exchanger 30. FIG. 10 is an exploded view of the first heat exchanger 30 shown in FIG. 9. FIG. 11 is a perspective view of a second heat exchanger 40 according to another embodiment of the present invention in the heat exchange module 2 shown in FIG. 8. FIG. 12 is an exploded view of the second heat exchanger 40 shown in FIG. 11. The heat exchange module 2 is of a substantially enclosed structure in which same is surrounded by heat exchangers, and has two substantially quadrilateral lateral portions which are opposite each other and two substantially trapezoidal lateral portions which are opposite each other. The heat exchange module 2 comprises the first heat exchanger 30 and the second heat exchanger 40, as shown in FIGS. 9 and 11.

As shown in FIGS. 9 and 10, the first heat exchanger 30 comprises a first sub-heat exchanger 500 and a second sub-heat exchanger 600. The first sub-heat exchanger 500 and the second sub-heat exchanger 600 respectively constitute a set including a substantially quadrilateral main heat exchanger and a substantially trapezoidal lateral heat exchanger, which are adjacent to each other, in the heat exchange module 2. The first sub-heat exchanger 500 is disposed in a longitudinal direction of a heat exchange apparatus. The second sub-heat exchanger 600 and the first sub-heat exchanger 500 are disposed such that same are substantially perpendicular to each other.

The first sub-heat exchanger 500 has a first manifold 510, a second manifold 520, and at least two heat exchange tubes which extend between the first manifold 510 and the second manifold 520 and are in fluid communication with the first manifold 510 and the second manifold 520. Fins are disposed on the heat exchange tubes.

The second sub-heat exchanger 600 has a third manifold 610, a fourth manifold 620, and at least one heat exchange tube which extends between the third manifold 610 and the fourth manifold 620 and is in fluid communication with the third manifold 610 and the fourth manifold 620. Fins are disposed on the heat exchange tube(s).

Different from the first sub-heat exchanger 100 in FIG. 4, in the first sub-heat exchanger 500 shown in FIG. 10, the third heat exchange region III is omitted. That is, an external pipeline 540 located outside the first sub-heat exchanger 500 is used to provide a refrigerant to a third inlet 611 of the third manifold. The external pipeline 540 has a fourth inlet 511 aligned with a first inlet 512 of the first manifold 510, and the external pipeline 540 is disposed in the direction of a heat exchange tube of the first sub-heat exchanger 500 and is closely adjacent to the first sub-heat exchanger 500. Correspondingly, only one first inlet 512 is provided on the first manifold 510. On the second manifold 520, the outlet is omitted, and only one second inlet 522 is provided. In addition, compared with the first sub-heat exchanger 100 in FIG. 4, in the first sub-heat exchanger 500 shown in FIG. 10, the partition that divides the first heat exchange region I and the second heat exchange region II in the second manifold 520 is further omitted, and only one outlet 514 is provided on the first manifold 510. That is, the outlets 113 and 114 of the first sub-heat exchanger 100 in FIG. 4 are combined into one outlet 514.

Figure 13:
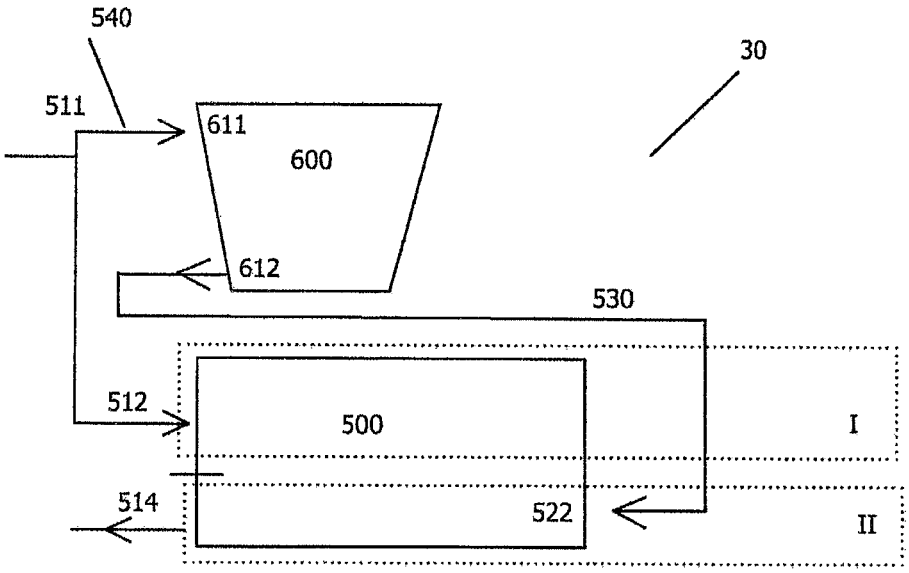
FIG. 13 is a schematic view of a flow path of the first heat exchanger shown in FIG. 9.

The second sub-heat exchanger 600 in FIG. 10 is substantially the same as the second sub-heat exchanger 200 shown in FIG. 5 in the first embodiment, except that the third inlet 611 and a second outlet 612 of the second sub-heat exchanger 600 are disposed so as to be perpendicular to the third manifold 610, that is, disposed on the lateral portion of the third manifold 610, and an opening direction of the third inlet 611 and the second outlet 612 may be perpendicular to the third manifold 610. The second outlet 612 is connected, by means of a bent tube 530, to the second inlet 522, which is provided perpendicularly to the second manifold 520, on the second manifold 520. That is, the second inlet 522 is provided on the lateral portion of the second manifold 520, and an opening direction of the second inlet 522 may be perpendicular to the second manifold 520. FIG. 13 is a schematic view of a flow path of the first heat exchanger 30 shown in FIG. 9. During use, the fourth inlet 511, the external pipeline 540, the third inlet 611, the second sub-heat exchanger 600, the second outlet 612, the second inlet 522, the second heat exchange region II, and a first outlet 514 form a first loop. The first inlet 512 on the first manifold 510, the first heat exchange region I, the second manifold 520, the second heat exchange region II, and the first outlet 514 form a second loop. The second heat exchange region II is used not only as a backflow section in the first loop but also as a subsequent supercooling section in the second sub-heat exchanger 600. A refrigerant in the first loop and a refrigerant in the second loop converge in the second manifold 520 of the first sub-heat exchanger 500. In the heat exchanger according to the present invention, outlet temperatures and outlet pressures of the two loops may be kept consistent, thereby avoiding the situation where outlet parameters of the two loops are inconsistent. The supercooling section can adjust the flows of the two loops so as to implement a balance between pressure drops and flows of the two loops (a large flow for a large area/a small flow for a small area), so that the overall heat exchange effect reaches the optimal state.

It should be noted that no description is given for those portions in the first heat exchanger 30 shown in FIG. 9 which are the same as those in the first heat exchanger 10 in the heat exchange module 1 shown in FIG. 2.

As shown in FIGS. 11 and 12, the second heat exchanger 40 comprises a third sub-heat exchanger 700 and a fourth sub-heat exchanger 800. The third sub-heat exchanger 700 and the fourth sub-heat exchanger 800 respectively constitute another set including a substantially quadrilateral main heat exchanger and a substantially trapezoidal lateral heat exchanger, which are adjacent to each other, in the heat exchange module 2. The third sub-heat exchanger 700 is disposed in a longitudinal direction of the heat exchange apparatus, and the fourth sub-heat exchanger 800 and the third sub-heat exchanger 700 are disposed such that same are substantially perpendicular to each other.

The third sub-heat exchanger 700 has a first manifold 710, a second manifold 720, and at least two heat exchange tubes which extend between the first manifold 710 and the second manifold 720 and are in fluid communication with the first manifold 710 and the second manifold 720. Fins are disposed on the heat exchange tubes. A first inlet 712 and a first outlet 714 are provided on the first manifold 710. A second inlet 722 is provided on the second manifold 720.

The fourth sub-heat exchanger 800 has a third manifold 810, a fourth manifold 820, and at least one heat exchange tube which extends between the third manifold 810 and the fourth manifold 820 and is in fluid communication with the third manifold 810 and the fourth manifold 820. Fins are disposed on the heat exchange tube(s). A third inlet 811 and a second outlet 812 are provided on the third manifold 810.

The second heat exchanger 40 is similar to the first heat exchanger 30 shown in FIG. 9. The difference between the second heat exchanger 40 and the first heat exchanger 30 shown in FIG. 9 lies in that in the second heat exchanger 40 in FIG. 11, the first manifold 710 of the third sub-heat exchanger 700 and the third manifold 810 of the fourth sub-heat exchanger 800 are fixed adjacent to each other, and the second outlet 812 on the third manifold 810 is in communication with the second inlet 722 on the second manifold 720 by means of an external pipeline 730 extending in the direction of a heat exchange tube of the third sub-heat exchanger 700. A refrigerant directly entering the fourth sub-heat exchanger 800 from the third inlet 811 flows into the second heat exchange region II in the third sub-heat exchanger 700 through the second inlet 722 on the second manifold 720, so that the second heat exchange region II in the third sub-heat exchanger 700 is used as a supercooling section of the fourth sub-heat exchanger 800. A fourth inlet 711 on the first manifold 710 of the third sub-heat exchanger 700 is disposed near the third inlet 811 of the fourth sub-heat exchanger 800, so that the first inlet 712 of the third sub-heat exchanger 700 and the third inlet 811 of the fourth sub-heat exchanger 800 may be in communication with a common inlet (not shown in the figure) of the second heat exchanger 40 in the same way as the fourth inlet 111 and the first inlet 112 of the first sub-heat exchanger 100 in the heat exchange module 1 shown in FIG. 1.

Figure 14:
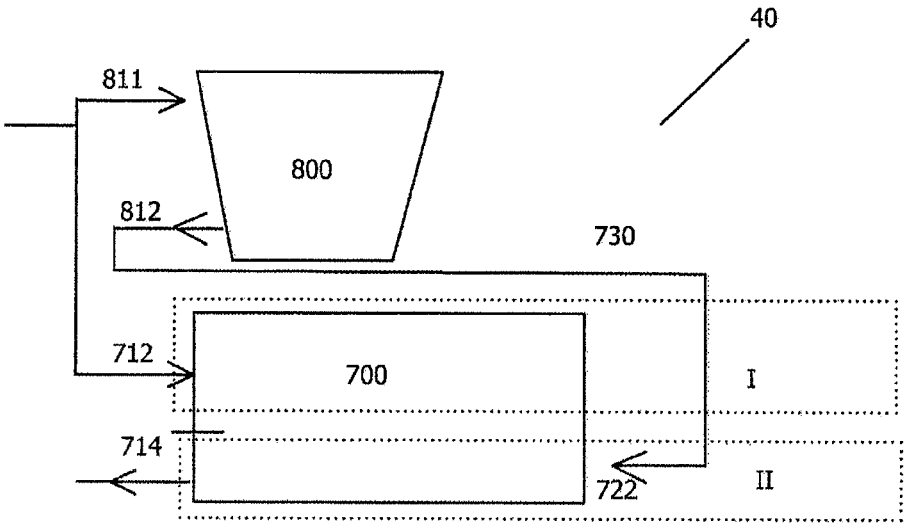
FIG. 14 is a schematic view of a flow path of the second heat exchanger shown in FIG. 12.

FIG. 14 is a schematic view of a flow path of the second heat exchanger 40 shown in FIG. 12. During use, the first inlet 712, the first heat exchange region I, the second manifold 720, the second heat exchange region II, and the first outlet 714 form a third loop. The third inlet 811, the fourth sub-heat exchanger 800, the second outlet 812, the external pipeline 730, the second inlet 722, the second heat exchange region II, and the first outlet 714 form a fourth loop. The second heat exchange region II is used not only as a backflow section in the third sub-heat exchanger 700 but also as the supercooling section in the fourth sub-heat exchanger 800.

Figure 15:
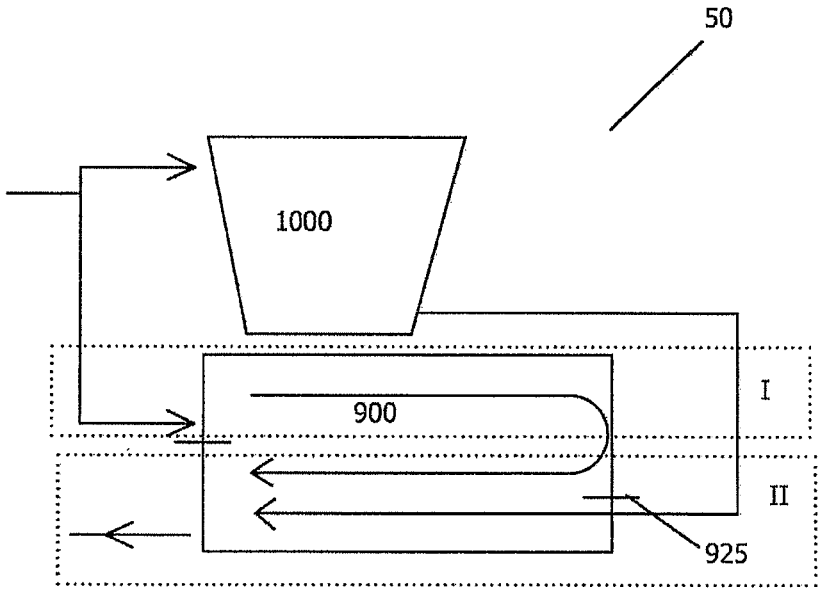
FIG. 15 is a schematic view of a flow path of a heat exchanger according to another embodiment of the present invention.

FIG. 15 is a schematic view of a flow path of a heat exchanger 50 according to another embodiment of the present invention. The heat exchanger 50 is similar to the foregoing heat exchanger 30 or 40, except that a fifth partition is disposed in a region, corresponding to the second heat exchange region II, of a second manifold, so that a refrigerant passing through the first heat exchange region I of a sub-heat exchanger 900 and a refrigerant from a sub-heat exchanger 1000 independently pass through two groups of heat exchange tubes in the second heat exchange region of the sub-heat exchanger 900 respectively, are mixed in the first manifold, and then flow out of the heat exchanger 50. For clarity, those portions of the heat exchanger 50 which are similar to those of the heat exchanger 30 or 40 are not described.

The main design idea of the present invention lies in that one heat exchanger uses some of the heat exchange tubes in another heat exchanger as part of the loop thereof. Especially with respect to a heat exchange apparatus on an air-cooled water chilling unit or a commercial rooftop unit, different heat exchangers are connected and spliced by means of pipelines to form a heat exchange apparatus, the periphery of which is substantially enclosed, wherein one lateral heat exchanger located at a lateral portion of the heat exchange apparatus uses some of the heat exchange tubes in a main heat exchanger that is adjacent to the lateral heat exchanger and is arranged in an arrangement direction of the heat exchange apparatus. The lateral heat exchanger and the main heat exchanger use the same common inlet and/or outlet. In the heat exchange apparatus according to the present invention, the substantially trapezoidal or V-shaped space of the heat exchange apparatus can be sufficiently utilized, thereby improving the heat exchange efficiency and making it convenient to manufacture, transport, and assemble the heat exchange apparatus. Therefore, implementations that conform to the design idea all fall within the scope of protection of the present invention.

The foregoing embodiments do not constitute a limitation on the present invention. A person skilled in the art may conceive of other variants within the scope of the design idea of the present invention based on the present invention. For example, the number of inlets and outlets in the manifolds may be increased based on the existing embodiments, so that the increased inlets and outlets are combined and used with other pipelines and heat exchangers. Although four lateral portions of the heat exchange module described herein are all surrounded by heat exchangers, some of the lateral portions may be not surrounded by heat exchangers, such that the entire heat exchange module becomes an open structure. Alternatively, a conventional metal plate or wind shield plate is used to enclose a lateral portion at which no heat exchanger is disposed so as to form an enclosed structure. Various features in the foregoing embodiments that include a plurality of features may be combined in any way to form a new embodiment, but it is not the intention to limit same to all the foregoing features included in the embodiments. For example, the heat exchange module is not limited to the two heat exchange modules disclosed herein. Instead, all heat exchange modules including the heat exchanger according to the idea of the present invention fall within the scope of the present invention, regardless of how the heat exchanger according to the idea of the present invention is combined with other heat exchangers. The scope of protection of the present invention is subject to the text recorded in the claims. It should be emphasized that corresponding partitions may be disposed in the manifolds as needed to separate corresponding functional regions and extend heat exchange paths. In the descriptions of the present invention, not all the arrangements of partitions that a person skilled in the art can conceive of according to the design idea of the present invention are described.

What is claimed is:

1. A heat exchanger, comprising:

a first sub-heat exchanger having a first manifold, a second manifold, and at least two heat exchange tubes which extend between the first manifold and the second manifold and are in fluid communication with the first manifold and the second manifold; and a second sub-heat exchanger having a third manifold, a fourth manifold, and at least one heat exchange tube which extends between the third manifold and the fourth manifold and is in fluid communication with the third manifold and the fourth manifold, wherein at least one of the heat exchange tubes in the first sub-heat exchanger is part of a refrigerant flow path of the second sub-heat exchanger, wherein the first sub-heat exchanger comprises a first heat exchange region and a second heat exchange region, wherein the first heat exchange region and the second heat exchange region are spaced apart by a first partition disposed in the first manifold and are distributed in a longitudinal direction of the manifold, wherein the first sub-heat exchanger comprises a first inlet, a second inlet, and a first outlet, and the second sub-heat exchanger comprises a third inlet and a second outlet, wherein the first inlet is located in the first heat exchange region, and the second inlet and the first outlet are located in the second heat exchange region, and wherein the second outlet is in fluid communication with the second inlet, wherein the first heat exchange region and the second heat exchange region are in fluid communication by means of the second manifold, and wherein the first sub-heat exchanger further comprises a third heat exchange region, wherein the third heat exchange region is spaced apart from the first heat exchange region and the second heat exchange region by a third partition in the first manifold and a fourth partition in the second manifold, a fourth inlet and a fourth outlet are provided in the third heat exchange region, and the fourth outlet is in fluid communication with the third inlet.

2. The heat exchanger according to claim 1, wherein a second partition is disposed in the second manifold, so that the first heat exchange region and the second heat exchange region are not in fluid communication, and a third outlet is provided in the first heat exchange region, so that a refrigerant entering the first inlet passes through the first heat exchange region and then exits from the third outlet.

3. The heat exchanger according to claim 1, wherein the second manifold and the third manifold are fixed adjacent to each other, the fourth outlet and the second inlet are provided on the second manifold, and the third inlet and the second outlet are provided on the third manifold.

4. The heat exchanger according to claim 3, wherein the fourth outlet and the third inlet are respectively provided at end portions, on the same side, of the second manifold and the third manifold, and the fourth outlet is in fluid communication with the third inlet by means of a U-shaped tube; and the second inlet and the second outlet are respectively provided at end portions, on the other side, of the second manifold and the third manifold, and the second inlet is in fluid communication with the second outlet by means of another U-shaped tube.

5. The heat exchanger according to claim 1, wherein the second manifold and the third manifold are fixed adjacent to each other, the first inlet is provided on the first manifold, the third inlet is provided on the third manifold, the third inlet is connected to an external pipeline extending in the direction of the heat exchange tubes of the first sub-heat exchanger, and an inlet end portion of the external pipeline and the first inlet are provided on the same side of the heat exchanger.

6. The heat exchanger according to claim 1, wherein the first manifold and the third manifold are fixed adjacent to each other, the first inlet and the first outlet are provided on the first manifold, the second inlet is provided on the second manifold, the second outlet and the third inlet are provided on the third manifold, and the second inlet is in fluid communication with the second outlet by means of an external pipeline extending in the direction of the heat exchange tubes of the first sub-heat exchanger.

7. The heat exchanger according to claim 1, wherein the heat exchanger is a heat exchanger for a heat exchange apparatus on an air-cooled water chilling unit or a commercial rooftop unit, wherein one of the first sub-heat exchanger and the second sub-heat exchanger is a main heat exchanger which is disposed in a longitudinal direction of the heat exchange apparatus and which is substantially quadrilateral, and the other of the first sub-heat exchanger and the second sub-heat exchanger is a lateral heat exchanger which forms a predetermined included angle greater than zero with the first sub-heat exchanger and which is substantially trapezoidal.

8. The heat exchanger according to claim 7, wherein the lateral heat exchanger is composed of flat tubes and fins having gradually decreasing lengths, wherein assuming that the length of a first flat tube is $L_{flat1}$ and the length of a fin is $L_{fin1}$, then the dimensions of the lateral heat exchanger satisfy the following conditions:

the length of an $n^{th}$ flat tube is $L_{flatn}=L_{flat1}-2(n-1)*H*\tan(\alpha/2)$, the length of an $n^{th}$ fin is $L_{finn}=L_{fin1}-2(n-1)*H*\tan(\alpha/2)$, $H1=H*\cos(\alpha/2)$, and $\alpha1=180-(\alpha/2)$, where H is a centre-to-centre spacing of the flat tubes, a is an included angle between the third manifold and the fourth manifold, H1 is a groove-to-groove spacing on the manifolds, and $\alpha1$ is a bending angle of the flat tubes.

9. The heat exchanger according to claim 1, wherein at least two heat exchange tubes are disposed in the second heat exchange region, a fifth partition is disposed on a section, corresponding to the second heat exchange region, of the second manifold to divide the heat exchange tubes in the second heat exchange region into two groups, so that a refrigerant passing through the first heat exchange region passes through one group of heat exchange tubes in the second heat exchange region, and a refrigerant entering the second inlet passes through the other group of heat exchange tubes in the second heat exchange region, and the refrigerants passing through the two groups of heat exchange tubes in the second heat exchange region are mixed in the first manifold and then exit from the first outlet.

10. The heat exchanger according to claim 1, wherein the first sub-heat exchanger comprises a first heat exchange region and a third heat exchange region, wherein the third heat exchange region is spaced apart from the first heat exchange region by a third partition in the first manifold and a fourth partition in the second manifold, the first sub-heat exchanger comprises a first inlet and a third outlet that are located in the first heat exchange region and a fourth inlet and a fourth outlet that are located in the third heat exchange region, and the second sub-heat exchanger comprises a third inlet and a second outlet, wherein the fourth outlet is in fluid communication with the third inlet.

11. A heat exchange module for a heat exchange apparatus on an air-cooled water chilling unit or a commercial rooftop unit, the heat exchange module comprising at least one heat exchanger, the at least one heat exchanger comprising:

a first sub-heat exchanger having a first manifold, a second manifold, and at least two heat exchange tubes which extend between the first manifold and the second manifold and are in fluid communication with the first manifold and the second manifold; and a second sub-heat exchanger having a third manifold, a fourth manifold, and at least one heat exchange tube which extends between the third manifold and the fourth manifold and is in fluid communication with the third manifold and the fourth manifold, wherein at least one of the heat exchange tubes in the first sub-heat exchanger is part of a refrigerant flow path of the second sub-heat exchanger, wherein the first sub-heat exchanger comprises a first heat exchange region and a second heat exchange region, wherein the first heat exchange region and the second heat exchange region are spaced apart by a first partition disposed in the first manifold and are distributed in a longitudinal direction of the manifold, wherein the first sub-heat exchanger comprises a first inlet, a second inlet, and a first outlet, and the second sub-heat exchanger comprises a third inlet and a second outlet, wherein the first inlet is located in the first heat exchange region, and the second inlet and the first outlet are located in the second heat exchange region, and wherein the second outlet is in fluid communication with the second inlet, wherein the first heat exchange region and the second heat exchange region are in fluid communication by means of the second manifold, and wherein the first sub-heat exchanger further comprises a third heat exchange region, wherein the third heat exchange region is spaced apart from the first heat exchange region and the second heat exchange region by a third partition in the first manifold and a fourth partition in the second manifold, a fourth inlet and a fourth outlet are provided in the third heat exchange region, and the fourth outlet is in fluid communication with the third inlet.

12. The heat exchanger according to claim 2, wherein the first sub-heat exchanger further comprises a third heat exchange region, wherein the third heat exchange region is spaced apart from the first heat exchange region and the second heat exchange region by a third partition in the first manifold and a fourth partition in the second manifold, a fourth inlet and a fourth outlet are provided in the third heat exchange region, and the fourth outlet is in fluid communication with the third inlet.

13. The heat exchanger according to claim 2, wherein the second manifold and the third manifold are fixed adjacent to each other, the first inlet is provided on the first manifold, the third inlet is provided on the third manifold, the third inlet is connected to an external pipeline extending in the direction of the heat exchange tubes of the first sub-heat exchanger, and an inlet end portion of the external pipeline and the first inlet are provided on the same side of the heat exchanger.

14. The heat exchanger according to claim 2, wherein the first manifold and the third manifold are fixed adjacent to each other, the first inlet and the first outlet are provided on the first manifold, the second inlet is provided on the second manifold, the second outlet and the third inlet are provided on the third manifold, and the second inlet is in fluid communication with the second outlet by means of an external pipeline extending in the direction of the heat exchange tubes of the first sub-heat exchanger.

15. A heat exchange module for a heat exchange apparatus on an air-cooled water chilling unit or a commercial rooftop unit, the heat exchange module comprising at least one heat exchanger, the at least one heat exchanger comprising:

a first sub-heat exchanger having a first manifold, a second manifold, and at least two heat exchange tubes which extend between the first manifold and the second manifold and are in fluid communication with the first manifold and the second manifold; and a second sub-heat exchanger having a third manifold, a fourth manifold, and at least one heat exchange tube which extends between the third manifold and the fourth manifold and is in fluid communication with the third manifold and the fourth manifold, wherein at least one of the heat exchange tubes in the first sub-heat exchanger is part of a refrigerant flow path of the second sub-heat exchanger, wherein the first sub-heat exchanger comprises a first heat exchange region and a second heat exchange region, wherein the first heat exchange region and the second heat exchange region are spaced apart by a first partition disposed in the first manifold and are distributed in a longitudinal direction of the manifold, wherein the first sub-heat exchanger comprises a first inlet, a second inlet, and a first outlet, and the second sub-heat exchanger comprises a third inlet and a second outlet, wherein the first inlet is located in the first heat exchange region, and the second inlet and the first outlet are located in the second heat exchange region, and wherein the second outlet is in fluid communication with the second inlet, a second partition is disposed in the second manifold, so that the first heat exchange region and the second heat exchange region are not in fluid communication, and a third outlet is provided in the first heat exchange region, so that a refrigerant entering the first inlet passes through the first heat exchange region and then exits from the third outlet.

* * * * *